United States Patent [19]

Nagarajan

[11] Patent Number: 4,828,752

[45] Date of Patent: May 9, 1989

[54] TOILET SOAP CONTAINING POLYMERIC THICKENER

[75] Inventor: Madukkarai K. Nagarajan, Avon Lake, Ohio

[73] Assignee: The B. F. Goodrich Company, Akron, Ohio

[21] Appl. No.: 841,963

[22] Filed: Mar. 20, 1986

Related U.S. Application Data

[63] Continuation-in-part of Ser. No. 685,825, Dec. 24, 1984, abandoned.

[51] Int. Cl.[4] ..... C11D 3/37; C11D 17/00

[52] U.S. Cl. ..... 252/174.24; 252/134; 252/DIG. 16

[58] Field of Search ..... 252/132, 134, DIG. 16, 252/174, 174.17, 174.21, 174.23, 174.24, DIG. 2, DIG. 3, DIG. 15

[56] References Cited

U.S. PATENT DOCUMENTS

| | | | |
|---|---|---|---|
| 2,798,053 | 7/1957 | Brown | 252/174.24 |
| 4,265,778 | 5/1981 | Sonenstein | 252/DIG. 16 |
| 4,477,375 | 10/1984 | Grollier | 252/542 |
| 4,491,539 | 1/1985 | Hoskins et al. | 252/541 |

FOREIGN PATENT DOCUMENTS

| | | |
|---|---|---|
| 105500 | 6/1982 | Japan . |
| 167700 | 10/1983 | Japan . |
| 831856 | 4/1960 | United Kingdom . |
| 1041934 | 9/1966 | United Kingdom . |
| 2048931 | 12/1980 | United Kingdom . |
| 2095276 | 9/1982 | United Kingdom . |

*Primary Examiner*—Paul Lieberman
*Assistant Examiner*—Hoa V. Le
*Attorney, Agent, or Firm*—George A. Kap

[57] ABSTRACT

Toilet soap in solid form is the subject of this invention which contains 0.01 to 10% by weight of a natural or a synthetic polymeric thickener to impart to the soap improved processability, texture, humectancy, and lather quality and quantity.

13 Claims, No Drawings

TOILET SOAP CONTAINING POLYMERIC THICKENER

BACKGROUND OF THE INVENTION

This application is a continuation-in-part of application Ser. No. 685,825 filed Dec. 24, 1984 now abandoned.

This invention relates to solid toilet soap whether it is in bar, flake, or some other solid form, containing an effective amount of a polymeric thickener which imparts certain advantageous properties. Such properties particularly include improved processability, which results in higher line speed and therefore, higher production; improved texture, which translates into less cracks and a reduced quantity of defects; improved humectant property, which translates into protection against weight loss upon drying or storage; and improved quantity and quality of lather, which is indicative of better creaminess and improved softness.

As used herein, toilet soap includes the natural soap, synthetic detergent, and combination soap which is a mixture of natural and synthetic detergents. Also, the toilet soap of this invention includes the various soaps in bar, flake, and any other solid form. Using the more prevalent terminology in the soap industry, in a preferred embodiment, the solid toilet soap disclosed and claimed herein includes soap bars, syndet bars, and combo bars.

Natural soap is generally a saponification product of vegetable and animal fats and oils, particularly unsaturated fats and oils. Natural soap can also be made from synthetic fatty acids derived from petroleum wax. More specifically, natural soap is comprised primarily of water-soluble ammonium, alkali metal or alkanolamine salts of various fatty acids having chiefly from 12 to 18 carbon atoms. Typical examples of such soap bases are lauric, myristic, palmitic, stearic, oleic, linoleic and linolenic acids which may be derived from various sources, including animal fats and oils such as tallow, vegetable fats and oils such as coconut oil, fish oils, whale oils, and petroleum waxes. The sodium and potassium salts of tallow and coconut fats are preferred, with sodium tallow/sodium coconut soaps in the proportions of generally 90/10 to 50/50 being especially desirable. Particularly preferred proportions of these two soap bases are 85/15 to 70/30.

Soap bars can be prepared in the following manner beginning with neat soap. The method in which soap is manufactured is discussed at length in Encyclopedia of Chemical Technology (2d Ed.) Vol. 18, pp. 415–432. Conventionally, fatty acids or esters thereof are saponified in a kettle process or, more preferably, by a continuous saponification process, to yield a neat soap containing about 30% water. Additives are added to the neat soap, after which the moisture level is reduced in a drier to 10–15% and the soap is pelletized. The pelletized soap is placed in an amalgamator and a mixture of perfume and one or more other additives are added. In addition, an aqueous slurry containing other desirable ingredients may also be added at this point. Thereafter, the treated pellets are transferred to a plodder which screens the soap and extrudes it into a soap log. Soap bars are then produced from the log by means well known in the art.

Fully synthetic bars are higher priced specialty products which offer special properties not available in normal or natural soaps. Syndet bars are free of alkali and can be neutral or can be adjusted to acidic pH; they are used for certain skin problems; they lather and clean very well at various water hardnesses without forming a curd or precipitate; they are compatible with a large variety of additives; and they use less perfume than normal soaps.

Syndet toilet soap contains only synthetic surfactants and generally no soap, although soap can be included as a plasticizer/binder, as is later explained. The combo bars, as already mentioned, contain a combination of synthetic and normal soaps.

Generally, syndet bars comprise 30–70 parts surfactant, 10–30 parts plasticizer/binder, 10–30 parts filler, 0–20 parts additives, and 3–10 parts water, on weight of bars. The surfactants are responsible for the cleansing and lathering properties of the soap bars. Among the more prevalent surfactants are the following: fatty alcohol sulfates, alkane sulfonates, and acyl isethionates. Generally, anionic, nonionic, and amphoteric surfactants have been proposed. To obtain good processability and usage properties, the surfactant portion of the syndet bars is stabilized with plasticizers and binders, which strongly influence lathering, wear, and sloughing characteristics of the bars and serve simultaneously as emollients. Some typical examples of plasticizers/binders include fatty alcohols, paraffin, and fatty acids and their derivatives such as alkanolamines, esters of polyvalent alcohols, and even natural soap. Solid fillers are used to improve internal structure and hardness and to reduce cost of the bars. Examples of fillers include sodium sulfate and similar salts, calcium and other phosphates, talcum, puffed borax, starch, and mannitol. Other additives are used to impart or improve certain desired properties and to suppress undesired ones. Overall appearance, performance, dermatological and germicidal effects are enhanced by additives.

Natural soap plasticity stays rather constant in the normal temperature operating range of 30° to 45° C. whereas syndet base plasticity changes from very hard to very soft in the same processing range. Standard toilet soap lines are, nevertheless, used to make syndet toilet soap and combination toilet soap.

A plasticizer/binder in a toilet soap prevents separation of macroscopic aggregates caused by local stresses, which promote cracking tendencies. It is an obvious advantage of natural soap that the surfactant itself acts as a plasticizer and a binder simultaneously. The polymeric thickeners of this invention add to or enhance this natural plasticizer/binder action of natural soap.

U.S. Pat. No. 4,477,375 to Grollier discloses cleaning compositions containing a surfactant and a cationic polymer selected from cellulose ether derivatives containing quaternary ammonium groups and certain cyclic polymers. This patent discloses that JR-400® and Merquat 550® cationic polymers are preferred. When incorporated in the neat soap base tested herein, results indicated that the cationic polymers did not impart an apparent benefit as did the thickeners disclosed herein.

SUMMARY OF THE INVENTION

The invention herein relates to solid toilet soap, particularly toilet soap bars, containing 0.01 to 10 weight parts of a polymeric thickener, based on 100 weight parts of finished soap. The toilet soap herein includes natural soap, synthetic detergent, and combinations of the two. A preferred thickener is selected from water-swellable and water-soluble homopolymers of an acrylic acid, especially acrylic acid itself, and copolymers thereof with up to about 75% by weight of one or more suitable comonomers. The resulting toilet soaps can be produced at higher line-speeds, have less cracks and defects, have improved humectant properties which translate into protection against weight or moisture loss on drying or storage, and have improved lather quantity and quality which translates into improved creaminess and softness of the lather.

DETAILED DESCRIPTION OF THE INVENTION

The invention herein is directed to the incorporation of a polymeric thickener to natural, synthetic and combination soaps in order to increase the production rate of such soaps, reduce cracks and defects therein, protect soaps against moisture loss, and to improve lather quantity and quality. The lather-enhancing attributes of the particular thickeners useful herein result in creamier and softer soap lathers, which are desirable use characteristics of toilet soap.

Although the use of common plasticizer/binders in soaps is intended to prevent separation of soap aggregates, as already described, such use of plasticizers/-binders unfortunately has a deleterious effect on the soap lather. More specifically, the use of the common plasticizers/binders in soaps leads to reduced quantity and quality of lather which means that the resulting soap lather is less creamy and is not as soft.

It is unexpectedly discovered that the use of an effective amount of a polymeric thickener in the toilet soap does not depress neither the quantity nor the quality of lather but in fact enhances these properties while at the same time, improving the processsability parameters of toilet soap.

The invention, herein, therefore, relates to a toilet soap containing an effective amount of a polymeric thickener. Amount of the thickener is more precisely defined as being 0.01 to 10 weight percent, based on the weight of the resulting soap, preferably 0.1 to 5, and more preferably 0.2 to 1 weight part. The thickener can be added at the saponification stage in the preparation of a natural soap or at any other stage as long as the thickener is well admixed with the soap base. In the preparation of syndet and combination toilet soaps, the thickener can be added along with other ingredients of the formulation or at any other stage as long as it is adequately mixed with the ingredients.

The polymeric thickeners suitable herein include natural and synthetic thickeners which, when used in making solid toilet soap, result in some very important advantages. Based on actual use of the thickeners in solid toilet soap, the resulting soaps have shown improved processability, such as less cracks, breaks or twists of soap logs, which translates to increased line-speed in large-scale toilet soap manufacture; improved creaminess and softness of the soap lather which yields improved lather quality and quantity; and a reduced level of moisture loss due to drying of finished soap in storage.

The synthetic thickeners contemplated herein include commercially available polymeric thickeners like thickeners A through I noted in Table 1, available from The BFGoodrich Company, and other polymeric thickeners sold under tradenames such as Acrisint®, Junlon®, Rheogic®, Acrysol®, Alcoprint®, EMA®, Gaftex®, and Polycarbophil® polymeric materials. Particular thickeners in this group found suitable herein include thickeners A through I, referred to in Table 1, which are available from The BFGoodrich Company; Acrisint 310 thickener, available from Sigma Chemical Company; Junlon PW-150 and remainder of this series, available from Showa Tsusho Company of Japan; Rheogic series, available from Showa Tsusho Company of Japan; Hiviswako 103 and the rest of that series, available from Wako Pure Chemical Industries of Japan; Acrysol ICS-1 and related thickeners, available from Rohm & Haas; Alcoprint PTF and the related thickeners, available from Allied Colloids of Great Britain; EMA-91 and related thickeners, available from Monsanto Company; and Gaftex PT and similar thickeners, available from GAF Corporation.

Synthetic thickeners are generally selected from carboxyl containing polymers and polyamides. Preferred thickeners are selected from homopolymers of an acrylic acid, homopolymers of alkyl acrylates, and copolymers of an acrylic acid or an acrylic ester with suitable comonomers or with each other. Such thickeners can be non-crosslinked or lightly crosslinked and can be functionally identified as water-soluble or water-swellable. The lightly crosslinked materials herein are crosslinked with up to about 10% by weight of a suitable crosslinking agent, preferably up to 5%, and especially 0.01 to 2%. The non-crosslinked synthetic thickeners are generally soluble in water whereas the lightly crosslinked thickeners are generally swellable in water although there are some exceptions to these generalizations. In one instance, one such thickener is water-swellable although it is not crosslinked. At times, it is difficult to differentiate between water-soluble and water-swellable thickeners since some are water-soluble and water dispersible.

The natural thickeners include cellulose derivatives selected from alkali metal salts of carboxyalkyl celluloses and carboxyalkylhydroxyalkyl celluloses, hydroxyalkyl celluloses, alkyl and dialkyl celluloses, and alkylhydroxyalkyl celluloses. Specific examples of such cellulose derivatives are sodium carboxymethyl cellulose, methyl cellulose, and hydroxypropylmethyl cellulose. The natural thickeners also include the polysaccharides, such as the various gums derived from plant and tree exudates, marine plant extracts, seed extracts, fruit and vegetable extracts, fermentation products, and the like. Examples of such gums include guar gum, gum arabic, karaya gum, tragacanth gum, agar-agar, algin and its derivatives, carrageenin, carob bean gum, xanthan gum, pectin, and the like.

More particularly, the principal class of synthetic thickeners suitable herein are the polyacrylic acids which can be homopolymers of an alpha, beta-olefinically unsaturated monocarboxylic acid of 3 to 5 carbon atoms and copolymers thereof with one or more suitable comonomers. The acrylic acid copolymers are selected from copolymers of one or more mononunsaturated monocarboxylic acid of 3 to 5 carbon atoms copolymerized with up to about 75% by weight, preferably 1 to 50% and more preferably about 15 to 30% by weight, of one or more other copolymerizable monomers. Preferred acrylic acids for use in this invention have the following general structure:

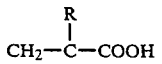

wherein R is a substituent selected from the class consisting of hydrogen, halogen, and the cyano (C═NH) groups, monovalent alkyl radicals, monovalent aryl radicals, monovalent alkyl radicals, monovalent aryl radicals, monovalent aralkyl radicals, monovalent alkaryl radicals and monovalent cycloaliphatic radicals. Of this class, acrylic and methacrylic acid are most preferred because of generally lower cost, ready availability and ability to form superior polymers.

Suitable comonomers are selected from alkyl acrylates represented by the following formula

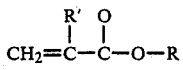

where R′ is hydrogen, methyl, or ethyl group; and R is an alkyl group of 10 to 30, preferably 10 to 20 carbon atoms; R can also be selected from alkyl, alkoxy, haloalkyl, cyanoalkyl, and the like groups, containing 1 tp 9 carbon atoms. Representative acrylates include methyl acrylate, ethyl acrylate, propyl acrylate, isopropyl acrylate, butyl acrylate, isobutyl acrylate, methyl methacrylate, methyl ethacrylate, ethyl methacrylate, octyl acrylate, heptyl acrylate, octyl methacrylate, isopropyl methacrylate, 2-ethylhexyl acrylate, nonyl acrylate, hexyl acrylate, n-hexyl methacrylate, decyl acrylate, isodecyl methacrylate, lauryl acrylate, stearyl acrylate, behenyl acrylate, melissyl acrylate and the corresponding methacrylates. Mixtures of two or three or more of the acrylic esters may be successfully polymerized with one of the carboxylic acid monomers. One useful class of copolymers are those methacrylates where the alkyl group contains 10 to 20 carbon atoms. Typical polymers have been made with about 15 weight percent isodecyl methacrylate, about 10 weight percent lauryl methacrylate, and about 7 weight percent stearyl methacrylate, with acrylic acid.

Other vinylidene comonomers may also be used, particularly in conjunction with acrylic esters, including the acrylic nitriles, olefinically unsaturated nitriles useful in the interpolymers embodied herein, preferably the monoolefinically unsaturated nitriles having from 3 to 10 carbon atoms such as acrylonitrile, methacrylonitrile, ethacrylonitrile, chloroacrylonitrile, and the like. Most preferred are acrylonitrile and methacrylonitrile. The amounts used, for example, for some polymers are from about 5 to 30 weight percent of the total monomers copolymerized.

Acrylic amides include monoolefinically unsaturated amides that may be incorporated in the interpolymers of this invention having at least one hydrogen on the amide nitrogen and the olefinic unsaturation is alpha-beta to the carbonyl group. Very much preferred are acrylamide and methacrylamide used in amounts, for example, from about 1 to 30 weight percent of the total monomers copolymerized. Other acrylic amides include N-alkylol amides of alpha, beta-olefinically unsaturated carboxylic acids including those having from 4 to 10 carbon atoms. The preferred monomers of the N-alkylol amide type are the N-alkylol amides of alpha, beta-monoolefinically unsaturated monocarboxylic acids and the most preferred are N-methylol acrylamide and N-methylol methacrylamide used in amounts for example of about 1 to 20 weight percent. N-alkoxymethyl acrylamides also may be used. The preferred alkoxymethyl acrylamides are those wherein the alkyl group contains from 2 to 5 carbon atoms and useful is N-butoxymethyl acrylamide.

Other vinylidene comonomers generally include, in addition to those described above, at least one other olefinically unsaturated monomer, more preferably at least one other vinylidene monomer (i.e., a monomer containing at least one terminal $CH_2=C<$ group per molecule) copolymerized therewith, for example up to about 30% or more by weight of the total monomers. Suitable monomers include α-olefins containing from 2 to 12 carbon atoms, more preferably from 2 to 8 carbon atoms, such as ethylene and propylene; dienes containing from 4 to 10 carbon atoms, including butadiene; vinyl esters and allyl esters such as vinyl acetate; vinyl aromatics such as styrene; vinyl and allyl ethers and ketones such as vinyl methyl ether and methyl vinyl ketone; cyanoalkyl acrylates such as α-cyanoalkyl acrylates, the α-, β- and -cyanopropyl acrylates, vinyl halides and vinyl chloride, vinylidene chloride and the like; esters of maleic and fumaric acid and the like.

It should be understood that synthetic thickeners can be devoid of a monounsaturated monocarboxylic acid or they can contain one or more of such acids together with one or more other acids and/or comonomers. In such cases, the thickeners are based on acrylic esters wherein such esters are present in an amount greater than 50%, preferably in excess of 70% by weight of all monomers.

The polyacrylic acids described herein can be cross-linked with a suitable polyfunctional vinylidene monomer containing at least two terminal $CH_2=C<$ groups, including for example, butadiene, isoprene, divinyl benzene, divinyl naphthalene, allyl acrylates and the like. Particularly useful cross-linking monomers for use in preparing the copolymers, if one is employed, are polyalkenyl polyethers having more than one alkenyl ether grouping per molecule. The most useful possesses alkenyl groups in which an olefinic double bond is present attached to a terminal methylene groups, $CH_2=C<$. They are made by the etherification of a polyhydric alcohol containing at least 4 carbon atoms and at least 3 hydroxyl groups. Compounds of this class may be produced by reacting an alkenyl halide, such as allyl chloride or allyl bromide, with a strongly alkaline aqueous solution of one or more polyhydric alcohols. The product is a complex mixture of polyethers with varying numbers of ether groups. Analysis reveals the average number of ether groupings on each molecule. Efficiency of the polyether cross-linking agent increases with the number of potentially polymerizable groups on the molecule. It is preferred to utilize polyethers containing an average of two or more alkenyl ether groupings per molecule. Other cross-linking monomers include for example, diallyl esters, dimethallyl ethers, allyl or methallyl acrylates and acrylamides, tetraallyl tin, tetravinyl silane, polyallkenyl methanes, diacrylates and dimethacrylates, divinyl compounds as divinyl benzene, polyallyl phosphate, diallyloxy compounds and phosphite esters, and the like. Typical agents are allyl pentaerythritol, allyl sucrose, trimethylolpropane triacrylate, 1,6-hexanediol diacrylate, trimethylolpropane diallyl ether, pentaerythritol triacrylate, tetramethylene dimethacrylate, tetramethylene diacrylate, ethylene diacrylate, ethylene dimethacrylate, triethylene glycol dimethacrylate, and the like. Allyl pentaerythritol, allyl sucrose and trimethylolpropane diallyl ether provide excellent polymers in amounts less than 5, as less than 3 weight percent, and particularly about 0.1 to 2.0% by weight of all monomers.

For purposes of clarification, it is pointed out that, generally speaking, the lightly crosslinked synthetic thickeners described herein swell in water whereas the non-crosslinked thickeners are soluble in water. Both types, however, are suitable in the invention herein.

The preferred polyacrylic acid homopolymers and copolymers useful herein, as described, include crosslinked and non-crosslinked polymers prepared in an organic solvent, especially benzene, have molecular weights in the range of about 200,000 to 5,000,000. Especially preferred are lightly crosslinked polyacrylic acid homopolymers of acrylic acid itself in the molecular weight range of about 500,000 to 4,000,000. The polyacrylic thickeners are in acid form which may be neutralized to a salt form for use in the invention described herein.

Other polycarboxylic resins, such as thickener H or thickener I in Table 1, are lightly crosslinked, swellable resin polymers containing a carboxylic acid as a major component. These materials are polymerized in an aqueous solution of a soluble nonredox divalent inorganic ion, such as magnesium sulfate. The salt is normally used at a level of above about one-half molar. The major component can be homopolymerized or copolymerized with a suitable comonomer. Suitable carboxylic acids include monounsaturated monocarboxylic and dicarboxylic acids containing 3 to 5 carbon atoms, salts thereof and anhydrides thereof. Specific examples thereof include acrylic acid and salts thereof, methacrylic acid and salts thereof, fumaric acid, maleic acid and its anhydride, itaconic acid, and the like. Acrylic acid is preferred. Polyunsaturated copolymerizable crosslinking agents, which form a minor component of these resins, have two or more double bonds subject to crosslinking with the monomers and can be aromatic or aliphatic. As disclosed in Example 1 of U.S. Pat. No. 2,810,716, such resins can be obtained by preparing a mixture of 100 grams of acrylic acid, 1.2 g of divinyl benzene, and 1.0 g of benzoylperoxide. This mixture is added to an aqueous saturated magnesium sulfate solution and heated to 95° C. After 16 minutes, 100.5 g of the resin is obtained, which is highly swelling. Such resins are well known in the art.

Polymerization of one or more monomers of the synthetic thickener described herein in the solvent or diluent medium is usually carried out in the presence of a free radical catalyst in a closed vessel and also in an inert atmosphere under autogenous pressure or artifically-induced pressure, or in an open vessel under reflux at atmospheric pressure. Temperature of the polymerization may be varied from about 0° to 100° C. or lower or higher, depending to a degree on the molecular weight desired in the polymer. Polymerization at 25° to 90° C. under autogenous pressure using a free radical catalyst is generally effective in producing polymer yields of 75% to 100%. Typical free radical forming catalysts include peroxygen compounds such as sodium, potassium and ammonium persulfates, caprylyl peroxide, benzoyl peroxide, hydrogen peroxide, pelargonyl peroxide, cumene hydroperoxides, tertiary butyl diperphthalate, tertiary butyl perbenzoate, sodium peracetate, sodium percarbonate, and the like, as well as azo catalysts and azodiisobutyryl nitrile, hereinafter referred to as azoisobutyronitrile. Other catalysts utilizable are the so-called "redox" type of catalyst and the heavy-metal activated catalyst systems. Ultra-violet light may also be used as a source of free radicals. Some systems polymerize solely by heat, but catalysts provide better control. The monomer may be batch charged or continuously added during the course of polymerization, or by any other manner of polymerization techniques conventionally used.

As stated, the polymerizations are normally conducted in inert diluents having some solubilizing effect on one or more of the monomeric ingredients but substantially none on the resulting polymers. In other words, the medium used for the polymerization is one in which the monomers are preferably soluble and the polymer is substantially insoluble. Such materials are normally organic liquids which are solvents for the monomers but are nonsolvents for the polymers, or a mixture of such solvents so that the polymer product is preferably obtained as a very fine friable or fluffy precipitate. Typical solvents include hydrocarbons containing 6 to 8 carbon atoms, benzene, xylene, tetralin, hexane, heptane, cyclohexane, carbon tetrachloride, chloroform, trichloroethylene, methyl chloride, ethyl chloride and methylene chloride; chlorofluoroalkanes such as chlorofluoromethane and chlorofluoroethane containing at least four halogen atoms; esters such as methyl acetate, ethyl acetate and butyl propionate; ketones such as methylethylketone, acetone, and dioxane; alcohols including methanol, ethanol, butanol, mineral spirits and the like. The amount or organic medium used normally will be in excess of the monomers to be polymerized and the proportion may vary from at least 1 weight percent of monomers and 99 weight percent organic medium up to about 50 weight percent monomers and 50 weight percent organic medium. Normally, a concentration of about 5 to 20 weight percent organic monomers is employed. Excellent results have been obtained with mineral spirits having a flash point greater at 120° F. containing 0 to 2% aromatics, 40 to 85% paraffins and 15 to 50% naphthenes.

In the practice of the invention, any of the general types of nonionic and anionic surfactants may be employed in the preparation of polymeric thickeners. The use of nonionic surfactants is preferred.

It is confirmed herein that the toilet soap of this invention has improved processability which translates to increased production rate in large scale manufacture of toilet soap. It is also confirmed herein that the soap of this invention has improved texture and improved lather quality and quantity yielding a soap lather that is creamier and softer whereas, as noted herein, the use of common plasticizers depresses lather formation. Lastly, it is also confirmed herein that the improved toilet soap claimed herein exhibits a reduced level of moisture loss due to drying or storage.

In addition to the specific data presented hereinbelow, certain general data and observations can also be made in support of the above allegations. Although it is difficult to generalize, it has been, nevertheless, found that control toilet soap without the thickeners described herein, yields soap lather volume of about 180 ml whereas with 1% thickener of this invention, the soap lather volume is about 220 mls. Furthermore, whereas control soap lather has viscosity of about 600 cps, the soap of this invention, containing 1% of a thickener, has viscosity of 1100 to 1500 cps. Also, whereas control soap has a density of about 41 grams per soap bar, the soap of this invention with 1% thickener, has density of about 41 to 44 grams per bar. Lastly, whereas control soap has weight loss on storage of about 13%, the soaps containing about 1% polymeric thickeners have weight loss of 6–9%. It has also been observed that the presence of a thickener reduces dramatically the average size of bubbles, which is indicative of improved creaminess.

The differences noted above, between soap with and without a thickener disclosed herein, are substantial differences which result in significant advantages. The thickeners disclosed herein impart varying degrees of improvement in terms of advantages discussed above.

The examples that follow, demonstrate certain features of the invention in greater detail with respect to preparation of a preferred thickener, and use of various thickeners in toilet soap bars which result in advantages of greater production rate, improved texture of the resulting soap, improved humectant property of the resulting soap, and better quality and higher quantity of lather from the soap.

EXAMPLE 1

This example demonstrates preparation of a polyacrylic acid from the following formulation, given in weight parts;

| | |
|---|---|
| acrylic acid | 100 |
| allyl pentaerythritol | 0.2 |
| lauroyl peroxide | 0.3 |
| benzene | 500 |

Polymerization was carried out under autogeneous pressure at 78° C. until reaction was complete in about 5 hours. The polymer produced, after removing benzene, was in the form of a fine, friable powder of about 1,000,000 molecular weight. For the particular application contemplated herein, the product was used in acid form although it can be neutralized with an alkali, such as sodium or potassium hydroxide, to develop its thickening properties. Since this product was lightly cross-linked, it was water-swellable and water dispersible.

EXAMPLE 2

This example demonstrates preparation of toilet soap bars with various natural and synthetic thickeners and testing thereof to evaluate processing characteristics, lather quality and quantity, soap bar density, and moisture loss thereof on storage.

For the sake of clarification, neat soap base is usually prepared by saponification of fats/oils that contain 12 to 18 carbon atoms. For purposes herein, soap base pellets containing 9.5% moisture of 85% tallow and 15% coconut oil mixture were obtained from a commercial source and charged into an amalgamator. The thickeners were added to the pelletized neat soap in the amalgamator, although they can be added at the saponification stage or at any other stage of toilet soap preparation. Since neat soap contained 9.5% moisture, additional demineralized water was added to adjust moisture of finished toilet soap to 15%. The recipe used for purposes of this example was as follows, given in weight parts:

| | |
|---|---|
| neat soap base pellets | 1000 grams |
| polymeric thickener | 10 grams |

-continued

| | |
|---|---|
| water (DM) | 80 grams |
| Total soap mass | 1090 grams |

The above soap mass was mixed in the amalgamator for 45 minutes and then transferred to the plodder where it was subjected to two passes using a noodle die and then to three passes using a rectangular log die. The soap log was then cut into uniform soap bars of $2\frac{1}{2}'' \times 1\frac{1}{2}'' \times \frac{3}{4}''$ (6.25 cm×3.75 cm×1.88cm). The operation described above was carried out with a 2.5 Lab Soap Processor equipment of Houchin Soap Machine Company, Division of Hughes Industries located in Cinnaminson, N.J.

During the final pass of the soap mass through the plodder, the following processing characteristics were assessed (a) log breaks during extrusion - judged on the basis of the length of the soap log before it broke into shorter lengths;

(b) twists during extrusion - judged on the basis of whether the soap log was straight or slightly twisted;

(c) cracks/chips in soap bars - judged on the basis cracks/chips on the cut face of the soap bars.

The processing characteristics were identified by a "yes" or a "no" and a negative indication to any one of the three items identified above signified good processability.

Lather volume was determined by a standardized hand-lathering procedure which involved washing of hands thoroughly using a particular toilet soap bar in tap water having 135 ppm as $CaCO_3$ hardness and a 2:1 ratio of calcium to magnesium, adjusted to 40° C. This procedure specifically required the following:

(a) thoroughly wetting the soap bar;

(b) taking the wet soap bar in both hands and giving it 10 twisting motions in the usual manner, and laying the soap bar aside;

(c) rubbing hands back and forth 10 times to generate lather;

(d) removing lather so formed by squeezing each hand back and forth and transferring the lather to a graduated beaker;

(e) repeating steps (a) to (d) four more times; and (f) reading and recording the milliliters of lather so obtained.

Lather viscosity was determined on the lather obtained from the lather volume test by measuring its viscosity at a shearing rate of 13.91 $sec^{-1}$ at 30° C. with a Brabender Rotational Rheoviscometer. Viscosity was recorded in centipoises, or cps.

Weight loss of soap bars was determined by initially recording the initial weight (Wi) of the bars. The bars were then placed in an oven maintained at 45° C. with forced air circulation and their weight was again recorded at end of 14 days ($W_{14}$). The weight percent loss was calculated as follows:

$$\% \text{ Weight Loss} = \frac{W_i - W_{14}}{W_i} \times 100$$

Results of the tests are given in Table 1, below:

TABLE 1

| Thickener | Processability Breaks | Twists | Cracks/chips | Lather Volume (ml) | Viscosity (cps) | In. Bar Wt. (gm) | % Wt. Loss |
|---|---|---|---|---|---|---|---|
| Control | Yes | Yes | Yes | 180 | 609 | 41.14 | 12.1 |
| Thickener A | No | Some | Some | 185 | 1211 | 40.82 | 6.9 |
| Thickener B | No | No | No (Soft Bar) | 220 | 1302 | 42.35 | 8.2 |
| Thickener C | No | No | No | 203 | 1204 | 42.35 | 8.0 |
| Thickener D | No | Some | Some | 210 | 1221 | 41.21 | 7.7 |
| Thickener E | No | Some | Some | 200 | 1316 | 40.51 | 8.2 |
| Thickener F | No | No | No | 210 | 1316 | 42.02 | 8.5 |
| Thickener G | No | No | Some | 215 | 1316 | 44.75 | 7.4 |
| Thickener H | No | Yes | No (Very soft) | 150 | 1162 | 41.35 | 7.6 |
| Thickener I | No | Yes | No (Very Soft) | 175 | 1232 | 41.83 | 7.3 |
| Acrysint 310 | No | No | Some | 188 | 1446 | 42.87 | 8.0 |
| Junlan PW-150 | No | No | No | 200 | 1330 | 42.06 | 7.4 |
| Hiviswako 103 | No | Yes | Some | 187 | 1274 | 40.60 | 7.3 |
| Acrysol ICS-1 | No | Yes | Some | 150 | 1120 | 41.89 | 7.3 |
| Alcoprint PTF | No | Yes | Some | 210 | 1358 | 39.73 | 7.3 |
| EMA-91 | No | No | Yes | 167 | 1120 | 40.71 | 6.1 |
| Gaftex PT | No | Yes | Some | 225 | 1106 | 41.45 | 6.6 |
| Guar Gum | No | Yes | Yes | 212 | 910 | 40.97 | 7.8 |
| Xanthan Gum | No | Yes | Yes | 200 | 784 | 41.58 | 7.3 |
| Carboxy-methyl cellulose | No | Yes | Yes | 212 | 728 | 41.28 | 8.0 |

In Table 1, Thickener A was non-crosslinked, water-soluble polyacrylic acid homopolymer prepared in benzene having molecular weight of 450,000; Thickeners B to F were lightly crosslinked polyacrylic acid homopolymers prepared in benzene and having molecular weight in the range of 750,000 to 4,000,000; Thickener G was a lightly crosslinked copolymer of a major proportion of acrylic acid and a minor proportion of fatty acid methacrylate also prepared in benzene; Thickeners H and I were also lightly crosslinked polyacrylic acid homopolymers prepared in water and having high molecular weight exceeding one million; Acrisint 310, Junlan PW-150, and Hiviswako 103 are known to be lightly crosslinked commercial polyacrylic acid homopolymers; and Acrysol ICS-1, Alcoprint PTF, EMA-91, and Gaftex PJ thickeners are known to be commercial acrylic acid copolymers.

EXAMPLE 3

Soap bars were prepared in the manner described in Example 2 using as thickeners, JR-400 and Merquat 550 in amounts indicated. JR-400 is a cationic cellulose ether and was obtained from Union Carbide whereas Merquat 550 is a cationic copolymer of dimethyldiallylammonium chloride and acrylamide and was obtained from Calgon Corporation. The processing characteristics of the resulting toilet soap bars containing the cationic polymers, are summarized in Table 2, below:

TABLE 2

| Thickener | Processability Breaks | Twists | Cracks/chips | Lather Volume (ml) | Viscosity (cps) | In. Bar (Wt. (gm) | % Wt. Loss |
|---|---|---|---|---|---|---|---|
| Control | YES | YES | YES | 180 | 609 | 41.14 | 12.1 |
| JR-400 | | | | | | | |
| 0.1% | YES | SOME | SOME | 180 | 354 | 40.30 | 12.5 |
| 0.3% | YES | YES | YES | 175 | 399 | 41.84 | 10.9 |
| 3.0% | YES | YES | YES | 175 | 420 | 40.95 | 11.2 |
| MERQUAT 550 | | | | | | | |
| 0.05% | YES | YES | YES | 163 | 350 | 40.89 | 11.9 |
| 0.5% | YES | YES | YES | 175 | 340 | 37.95 | 13.9 |

*At >0.5% in recipe, not possible to form a bar because of lack of cohesion/binding.

The "Control" toilet bar soap in Table 2 is the same as in Table 1. At 3.0% of JR-400 cationic polymer, the resulting toilet soap bars were rough whereas with 0.5% Merquat 550 cationic polymer, the soap bars were brittle. The above results clearly demonstrate that the use of a cationic polymer in a neat soap base does not appear to benefit the resulting soap bars in terms of the evaluated processing characteristics.

I claim:

1. A toilet soap in a solid form devoid of cationic polumer selected from cellulose derivatives containing quaternary ammonium groups and cyclic polymers which soap had improved processability, improved texture, improved humectant properties, and improved lather quality and quantity comprising (a) a major proportion of a soap base selected from natural soap, synthetic detergent, and mixtures thereof;

(b) an effective amount of a thickener having molecular weight in excess of about 750,000 selected from homopolymers of mono- and dicarboxylic acids of 3 to 5 carbon atoms and copolymers thereof with up to 75% by weight of one or more copolymerizable monomers, said copolymers containing polymerized therein not more than 30% by weight of an acrylic amide; homopolymers of lower alkyl acrylates and copolymers containing polymerized therein in excess of 50% by weight of said lower alkyl acrylates; salts of said thickeners; and mixtures of aid thickeners and salts thereof; and (c) from 0.01 to 10% of a crosslinking agent.

2. Toilet soap of claim 1 wherein amount of said thickener is about 0.2 to 1 weight percent, based on the weight of said soap; wherein said thickener is selected from homopolymers of an acrylic acid defined as follows:

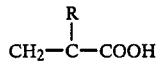

where R is selected from hydrogen, halogen, cyano, alkyl, aryl, aralkyl, alkaryl, and cycloaliphatic groups, and salts of said acid; copolymers of said acid or its salt with 1 to 50% by weight of one or more suitable comonomers; homopolymers of lower alkyl acrylates and copolymers thereof with one or more suitable comonomers; and mixtures thereof; and wherein molecular weight of said thickener is in the range of up to about 5,000,000.

3. Toilet soap of claim 2 wherein said thickener is selected from water-swellable homopolymers of acrylic acid itself or a salt thereof and copolymers of acrylic acid itself or a salt thereof with 1 to 50% by weight of one or more suitable comonomers; wherein said thickener has molecular weight of up to 4,000,000; and wherein amount of said crosslinker is about 0.01 to 2% by weight.

4. Toilet soap of claim 3 wherein said comonomers are selected from acrylates of the following formula:

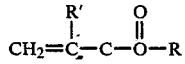

where R′ is selected from hydrogen, methyl, and ethyl groups; and R is selected from alkyl groups of 10 to 30 carbon atoms and from alkyl, alkoxy, haloalkyl, and cyanoalkyl groups containing 1 to 9 carbon atoms; and wherein said crosslinking agent is selected from allyl sucross, allyl pentaerythritol, trimethylolpropane diallyl ether, and mixtures thereof.

5. Toilet soap of claim 3 wherein said comononers are selected from alkyl acrylates and methacrylates containg 1 to 20 carbon atoms in the alkyl group, acrylonitrile, methacrylonitrile, acrylamide, methacrylamide, N-methyl acrylamide, N-t-butyl acrylamide, N-methylol acrylamide, N-ethanol acrylamide, N-methylol methacrylamide, N-ethanol methacrylamide, N-methylol-p-vinyl benzene, N-butoxymethyl acylamide, ethylene, proplene, butadiene, vinyl acetate, styrene, vinyl methyl ether, methyl vinyl ketone, alpha-cyanomethyl acrylate, vinyl cloride, vinylidene cloride, and mixtures thereof.

6. Toilet soap of claim 2 wherein said acrylic acid is selected from acrylic acid, methacrylic acid, and mixtures of such acids; and amount of said comonomers is 1 to 50% by weight which are selected from alkyl acrylates and methacrylates containing 1 to 20 carbon atoms in the alkyl group; said homopolymers and copolymers, in acid or salt form, have molecular weight in the range of up to about 4,000,000.

7. Toilet soap of claim 2 wherein said thickener is selected from homopolymers of acrylic acid; homopolymers of methacrylic acid; and copolymers of an acrylic acid selected from acrylic acid itself, methacrylic acid, and mixtures thereof, with one or more comonomers selected from alkyl acrylates and methacrylates containing 1 to 20 carbon atoms, said copolymers containing about 15 to 30% by weight one or more polymerized comonomers; wherein molecular weight of said thickener is in the range of up to about 4,000,000; and wherein said crosslinking agent is selected from allyl sucrose, allyl pentaerythritol, trimethylolpropane diallyl ether, and mixtures thereof.

8. A toilet soap selected from soap bars and soap flakes devoid of cationic polymers selected from cellulose devatives containing quaternary ammonium groups and cyclic polymers which soap has improved processability, improved texture, improved humectant properties, and improved lather quality and quantity comprising (a) a major proportion of a soap base selected from natural soap, synthetic detergent, and mixtures thereof;

(b) an effective amount of a thickener having molecular weight in excess of about 750,000 selected from homopolymers of monounsaturated monocarboxylic and dicarboxylic acids of 3 to 5 carbon atoms and copolymers thereof with up to 75% by weight of one or more copolymerizable monomers, said copolymers containing polymerized therein not more than 30% by weight of an acrylic amide; homopolymers of lower alkyl acrylates and copolymers thereof with one or more suitable comonomers, said copolymers containing polymerized therein in excess of 50% by weight of lower alkyl acrylates; salts of said thickeners; and mixtures of said thickeners and salts thereof; and (c) form 0.01 to 10% of a crosslinking agent.

9. Toilet soap of claim 8 wherein amount of said thickener is 0.2–1% by weight, based on the weight of said toilet soap; and wherein said natural soap comprises a mixture of salts of fatty acids of 12 to 18 carbon atoms and said synthetic detergent comprises 30 to 70 weight parts surfactant, 10 to 30 weight parts plasticizer/-binder, 10 to 30 weight parts filler, 3 to 10 weight parts water, and up to 20 weight parts additives that excludes said thickener.

10. Toilet soap of claim 9 wherein said thickener is water-swellable and is selected from homopolymers of monounsaturated monocarboxylic and dicarboxylic acids of 3 to 5 carbon atoms, and salts thereof, and copolymers thereof with 1 to 50% by weight of one or more copolymerizable monomers; homopolymers of lower alkyl acrylates and copolymers thereof with one or more suitable comonomers; and mixtures thereof.

11. Toilet soap of claim 10 wherein said thickener is selected from homopolymers of an acrylic acid defined as follows:

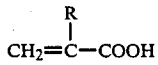

where R is selected from hydrogen, halogen, cyano, alkyl, aryl, aralkyl, and cycloaliphtic groups, and salts of said acid; copolymers of said acid or its salt with 1 to 50% by weight of one or more suitable comonomers; homopolymers of lower alkyl acrylates and copolymers thereof with one or more suitable comonomers; and mixtures thereof.

12. Toilet soap of claim 11 wherein said thickener is water-swellable selected from homopolymers of acrylic acid itself or a salt thereof and copolymers of acrylic acid itself or a salt thereof with 1 to 50% by weight of one or more suitable comonomers selected from alkyl acrylates and methacrylates of 1 to 20 carbon atoms in the alkyl group; wherein said homopolymers and copolymers, in acid or salt form, have molecular weight in the range of about up to about 5,000,000; and wherein amount of said crosslinker is about 0.01 to 2% by weight.

13. Toilet soap of claim 12 wherein said thickener is water-swellable polyacrylic acid homopolymer having molecular weight of up to about 4,000,000; and wherein said crosslinking agent is selected from allyl sucrose, allyl pentaerythritol, trimethylolpropane diallyl ether, and mixtures thereof.

* * * * *